US008882342B2

(12) United States Patent
Cattaneo et al.

(10) Patent No.: US 8,882,342 B2
(45) Date of Patent: Nov. 11, 2014

(54) WATCH CASE

(75) Inventors: Julien Cattaneo, Esery (FR); Daniel Moille, Yvoire (FR)

(73) Assignee: Rolex S.A., Geneva (CH)

( * ) Notice: Subject to any disclaimer, the term of this patent is extended or adjusted under 35 U.S.C. 154(b) by 152 days.

(21) Appl. No.: 13/643,462

(22) PCT Filed: Apr. 28, 2011

(86) PCT No.: PCT/CH2011/000094

§ 371 (c)(1),
(2), (4) Date: Dec. 14, 2012

(87) PCT Pub. No.: WO2011/137544

PCT Pub. Date: Nov. 10, 2011

(65) Prior Publication Data

US 2013/0100782 A1 Apr. 25, 2013

(30) Foreign Application Priority Data

May 4, 2010 (EP) ..... 10405094
Sep. 16, 2010 (EP) ..... 10405173

(51) Int. Cl.
*G04B 37/10* (2006.01)

(52) U.S. Cl.
CPC ..... *G04B 37/103* (2013.01)
USPC ..... 368/308; 368/319

(58) Field of Classification Search
CPC .... G04B 37/10; G04B 37/103; G04B 37/106; G04B 3/041
USPC ..... 368/286–90, 306–308, 319–321
See application file for complete search history.

(56) References Cited

U.S. PATENT DOCUMENTS 2,218,889 A * 10/1940 Marti ..... 368/288
2,309,428 A * 1/1943 Aegler ..... 368/288
3,061,869 A * 11/1962 Scalo et al. ..... 16/441

(Continued)

FOREIGN PATENT DOCUMENTS

CH 686 596 A3 5/1996
EP 0 556 155 A1 8/1993

(Continued)

OTHER PUBLICATIONS

International Search Report for PCT/CH2011/000094, mailing date of Nov. 23, 2011.

*Primary Examiner* — Amy Cohen Johnson
*Assistant Examiner* — Matthew Powell
(74) *Attorney, Agent, or Firm* — Westerman, Hattori, Daniels & Adrian, LLP

(57) ABSTRACT

This watch case comprises a middle (1), a tube (3, 23), which is secured to the middle (1) and is provided with a thread, a control crown (C) which is provided with a thread screwed onto the tube (3, 23), the control crown (C) having an external part (10, 20) that has a distinctive mark (S) that is visible from the outside and an internal part (2, 24) housed inside the external part (10, 20) and clamping means (11) for axially holding said external part (10, 20) and said internal part (2, 24) in an angular position determined with respect to the longitudinal axis of said tube. The internal part (2, 24) has first angular indexing means (2*a*, 24*a*), the external part (10, 20) having second angular indexing means (10*a*, 20*a*), these indexing means being shaped so as to engage axially in one another.

20 Claims, 3 Drawing Sheets

(56) References Cited

U.S. PATENT DOCUMENTS

| | | | | |
|---|---|---|---|---|
| 5,184,334 | A * | 2/1993 | Vollert | 368/319 |
| 5,383,166 | A | 1/1995 | Gallay | |
| 2003/0007426 | A1 | 1/2003 | Ecoffet | |
| 2004/0130971 | A1 | 7/2004 | Ecoffet et al. | |
| 2004/0257917 | A1 * | 12/2004 | Yoshikawa | 368/318 |
| 2005/0207285 | A1 * | 9/2005 | Omori et al. | 368/319 |

FOREIGN PATENT DOCUMENTS

| | | | |
|---|---|---|---|
| EP | 1 124 167 | A1 | 8/2001 |
| EP | 1 411 401 | A1 | 4/2004 |
| EP | 1 701 225 | A1 | 9/2006 |
| EP | 1 727 005 | A1 | 11/2006 |
| EP | 2 182 417 | A2 | 5/2010 |
| WO | 01/40881 | A1 | 6/2001 |

* cited by examiner

WATCH CASE

The present invention relates to a watch case comprising a middle, a tube which is integral with the middle and is provided with a thread, a control crown provided with a thread which can be screwed onto the thread of said tube, the control crown comprising an outer part with a distinctive mark which can be seen from the exterior, and an inner part which is accommodated inside of the outer part and is provided with said thread which can be screwed onto the thread of the tube, one of said parts comprising means for connection to a control rod, and in particular to a rod of a winding mechanism, and clamping means in order to keep said outer part and said inner part axially in an angular position which is determined relative to the longitudinal axis of said tube.

The production and assembly of crowns to be screwed onto watch cases are well known.

However, when the outer surface of the outer part of the crown has a distinctive mark, for esthetic reasons it is important to be able to guarantee that the distinctive mark is in an angular orientation which is determined relative to the longitudinal axis of the tube of the watch case to which the crown is screwed. Otherwise, the angular position of the distinctive mark is random.

A watch case of the aforementioned type has already been proposed in EP 1 701 225. In this document, the inner surface of the outer part comprises a frusto-conical surface, and the inner element of the crown has a second, complementary frusto-conical surface.

Resilient clamping means are used to clamp the two frusto-conical surfaces axially against one another in a relative angular orientation wherein the distinctive mark is in the required angular position.

With this solution, the conicity of the two frusto-conical surfaces must be almost identical. An excessively great difference of conicity would no longer make it possible to guarantee the securing of the outer part and the inner part of the crown after clamping, with the risk of permitting relative angular displacement of the outer part and the inner part. Furthermore, a flat seal is interposed between the inner surface of the base of the crown and the end of the tube onto which it is screwed. Since the compression of this seal depends on the degree of screwing of the crown, the precision of the angular orientation of the crown is necessarily limited.

EP 1 151 357 describes a watch case comprising a screwed crown, a ring which is positioned in an inner annular groove of the crown, and is provided with an inner female thread, and an intermediate tube comprising a threaded outer section which is designed to receive the inner female thread of the ring.

The inner female thread of the ring is indexed relative to a distinctive mark which is situated on an outer surface of the crown, and the intermediate tube is secured to the case such that it can be oriented and secured angularly relative to the case by means of a nut.

This solution is quite difficult to implement industrially, since the blocking of the nut generates clamping torque, whereas any retention in position is problematic because of the absence of areas of grasping, and because of the restricted space inside the watch case. In addition, this solution requires a template and a camera in order to index the inner female thread of the ring, and it involves a welding operation.

EP 1 411 401 describes a crown which comprises on an outer surface an added-on decorative element which bears a distinctive mark and can be oriented angularly relative to the crown by means of the use of resilient braking means.

This solution does not make it possible to obtain a satisfactory esthetic finish, since the join between the crown and the decorative element remains visible. In addition, the decorative element can be displaced accidentally because of the use of the resilient braking means.

EP 1 124 167 describes a screwed crown, the tube of which is not screwed into the middle of the watch case, but into a deformable alloy ring with shape memory which makes it possible, by means of its temporary deformation further to a temperature change which can change the phase of the shape memory material, to create play between the crown and the middle, in order to orient the crown angularly relative to the middle, according to a particular orientation.

This solution is problematic to implement since the change of phase of the shape memory material involves relatively large differences of temperature, whereas this material must resist oxidation in the case of coupling with noble materials, such as gold or platinum for example. Finally, this solution involves the risk that the two parts of the crown will become separated when the watch is subjected to extreme temperatures, such as, for example, when it is left in direct sunlight or behind glass, or when it is subjected to temperatures which are distinctly lower than 0° C. EP 1 727 005 describes a watch case crown which is screwed onto a threaded ring which is integral with a tube secured to the middle. This threaded ring is mobile in rotation, and is turned such that its thread is adjusted in a particular position before being blocked by means of a blocking unit such as a nut. Thus, the adjusted position of the thread of the threaded ring makes it possible to determine the final orientation of the crown.

However, this solution does not make it possible to obtain a precise orientation, and requires a tool in order to be able to release the ring from the blocking unit, so as to orient it and block it without it turning.

EP 2 182 417 describes a screwed crown which has three tubes, the first tube being connected to the crown and being screwed onto the second tube, the third tube being arranged so as to receive the second tube, the second tube and the third tube comprising indexing means.

The third tube comprises inner toothing which is provided on the inner periphery, and is designed to co-operate with a toothed crown of the second tube. The second tube and the third tube are kept blocked in translation by a ring, and form a sub-assembly with a thread which can be oriented, onto which the crown which is associated with the first tube is screwed.

The angular orientation is determined once and for all, and is directly associated with the number of teeth which are present on the second tube and the third tube, and the number of indexing positions is necessarily limited as a result of the small diameters of these tubes. Furthermore, this solution requires three tubes, and is difficult to put into place.

The object of the present invention is to eliminate at least partly the disadvantages of the solutions according to the above-described prior art.

For this purpose, the subject of the present invention is a watch case of the aforementioned type, and according to claim 1.

The appended drawing illustrates schematically and by way of example two embodiments of a watch case comprising a screwed crown which is the subject of this invention, as well as variants of the first embodiment.

Figure 1:
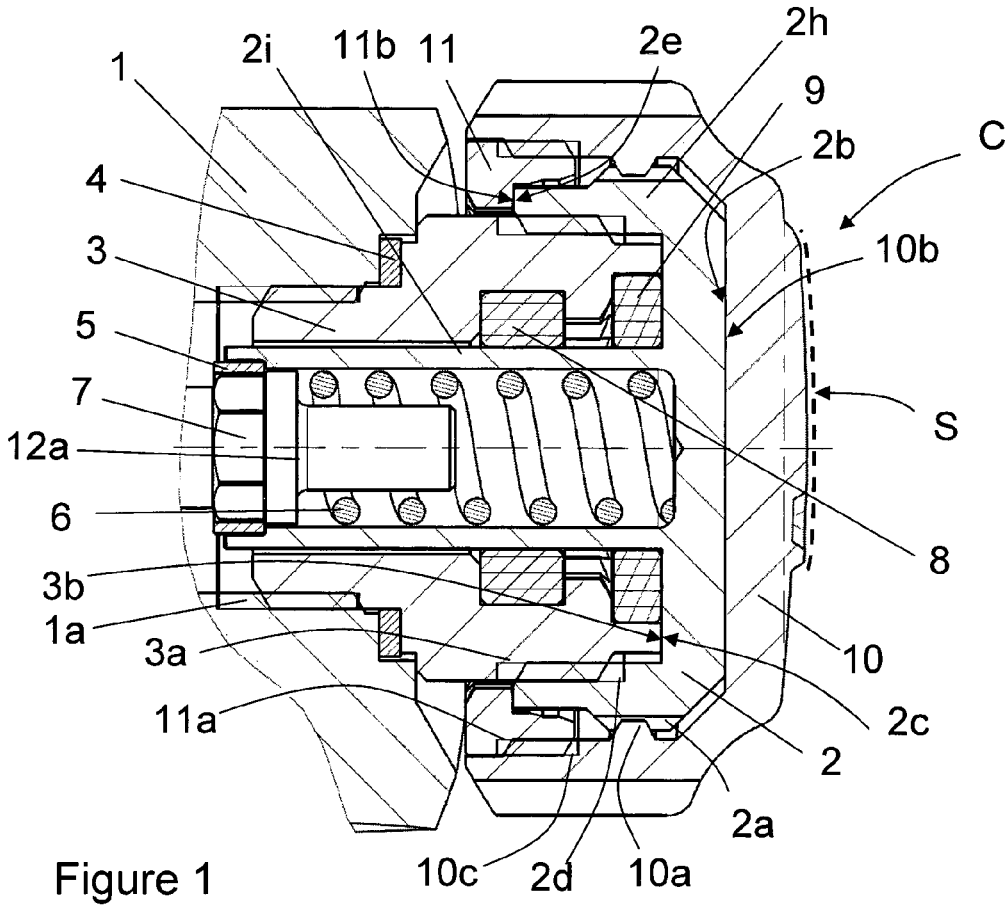
FIG. 1 is a partial view in cross-section of a watch case on a radial plane which passes via the axis of the rod of the winding mechanism, according to a first embodiment.

A crown C comprises an inner part 2 comprising a base 2*b* which has a circular lateral wall on its periphery.

This inner part is accommodated axially inside an outer part 10 which bears a distinctive mark S which can be seen from the exterior. This mark S can occupy a certain angular position around the longitudinal axis of a tube 3, according to the position of the crown C once it is screwed onto this tube.

In the first embodiment represented in FIGS. 1 to 4, the inner part 2 comprises a thread 2*d*, which is used to screw the inner part 2 onto a thread 3*a* of the tube 3, which itself is screwed onto, or rendered integral with, a radial passage 1*a* of a middle 1 of a watch case. The connection between the middle 1 and the tube 3 is sealed by means of a seal 4.

The inner part 2 of the crown C comprises a tubular sleeve 2*i* which bears on its inner end a coupling ring 5 with a polygonal opening in order to be engaged with a complementary polygonal coupling element 7 provided on the rod 12 of the winding mechanism.

A helical spring 6 is arranged in the sleeve 2*i*. It is supported firstly against the base of the tubular sleeve 2*i*, and secondly against a support surface 12*a* which is integral with the rod 12 of the winding mechanism.

The inner part 2 also comprises a thread 2*d* which is provided on the inner surface of a lateral wall 2*h* which surrounds the tubular sleeve 2*i* and is used to screw the crown C onto a thread 3*a* provided on the outer lateral surface of the tube 3.

In all the figures which illustrate the present invention, the rod of the winding mechanism is represented in the engaged position, whereas the winding mechanism crown C is represented in the screwed position. In reality, when the winding mechanism crown C is screwed onto the tube 3, the crown is displaced axially, whereas the rod 12 of the winding mechanism remains fixed. Consequently, the engagement ring 5 is displaced axially together with the crown C, such that it becomes separated from the coupling element 7 and compresses the helical spring 6 between the base of the crown C and the support surface 12*a* of the rod of the winding mechanism. The winding mechanism crown C is thus represented as if there were no watch movement inside the watch case, which does not cause a problem for the understanding of the invention.

The inner part 2 which is integral with the ring 5, the helical spring 6 and the rod 12 of the winding element together with the polygonal coupling element constitute a sub-assembly when it is introduced into the tube 3, inside which there are two O-ring seals 8 and 9. This sub-assembly is already known and is described in EP 0 556 155 and CH 686 596.

The inner part 2 of the crown C comprises micro-toothing or grooves 2*a* provided on a circular outer lateral surface of the lateral wall 2*h*. The outer part 10 of the crown C comprises complementary toothing or grooves 10*a* provided in the inner surface of its lateral wall, in which the inner part 2 of the crown C is accommodated. This complementary toothing or these grooves act(s) as an angular indexing means around the longitudinal axis of the tube 3.

The inner surface of the lateral wall of the outer part of the crown C also has a thread 10*c* situated between its opening and the toothing or grooves 10*a*, into which there is screwed a thread 11*a* which is provided on the periphery of a clamping ring 11. The inner wall of this clamping ring 11 comprises an axial support surface 11*b* which is designed to be engaged with the front end 2*e* of the lateral wall 2*h* of the inner part 2 which acts as a stop.

In order to permit the screwing of the ring 11, the latter comprises grasping means, in this case grooves 11*c* on its inner surface, and the outer part 10 of the crown comprises other means, in this case grooves 10*d* on its outer wall, which permit engagement with appropriate tools in order to screw the clamping ring into the outer part 10, until the base 2*b* of the inner part 2 meets the base 10*b* of the outer part.

The torque with which the clamping ring 11 is screwed is high enough for it not to become loosened, and for the inner part 2 to be kept blocked axially, thus perpetuating the blocking in rotation of the indexing toothing or grooves 2*a*, 10*a*.

Figure 3:
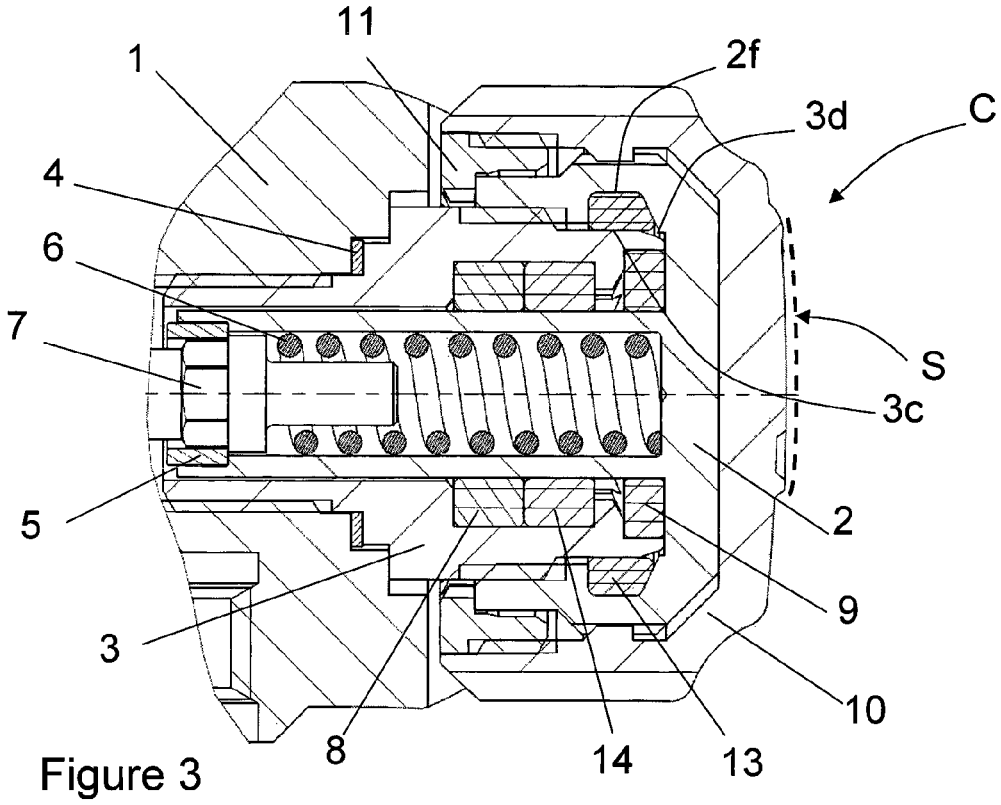
FIG. 3 is a variant of this first embodiment.

A variant of this first embodiment of the screwed crown C is represented in FIG. 3.

Figure 2:
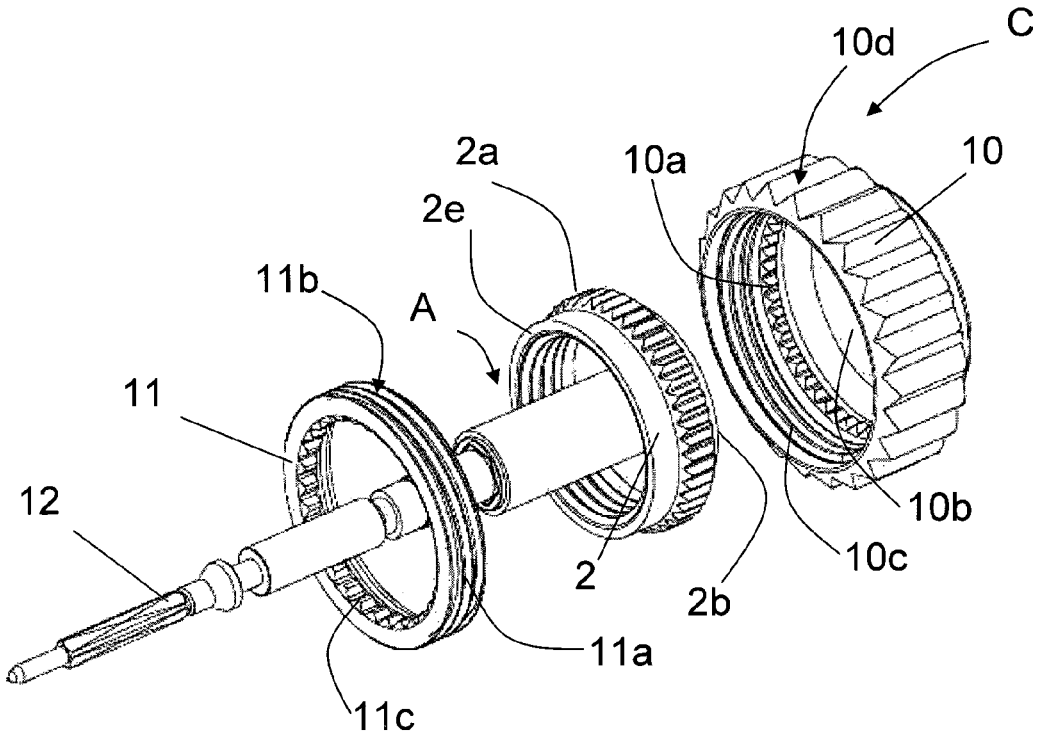
FIG. 2 is an exploded perspective view of the winding mechanism crown of this first embodiment.

This variant is distinguished from the embodiment in FIGS. 1 and 2 substantially in that the inner part 2 comprises an inner annular receptacle 2*f* which is designed to receive the O-ring seal 13 which comes into radial contact with the outer surface 3*c* of the tube 3. This outer surface 3 ends in a frusto-conical part 3*d* such as to allow the O-ring seal 13 to be deformed progressively during the screwing of the crown C. The tube 3 has an additional annular receptacle in order to receive an additional annular seal 14.

Figure 4:
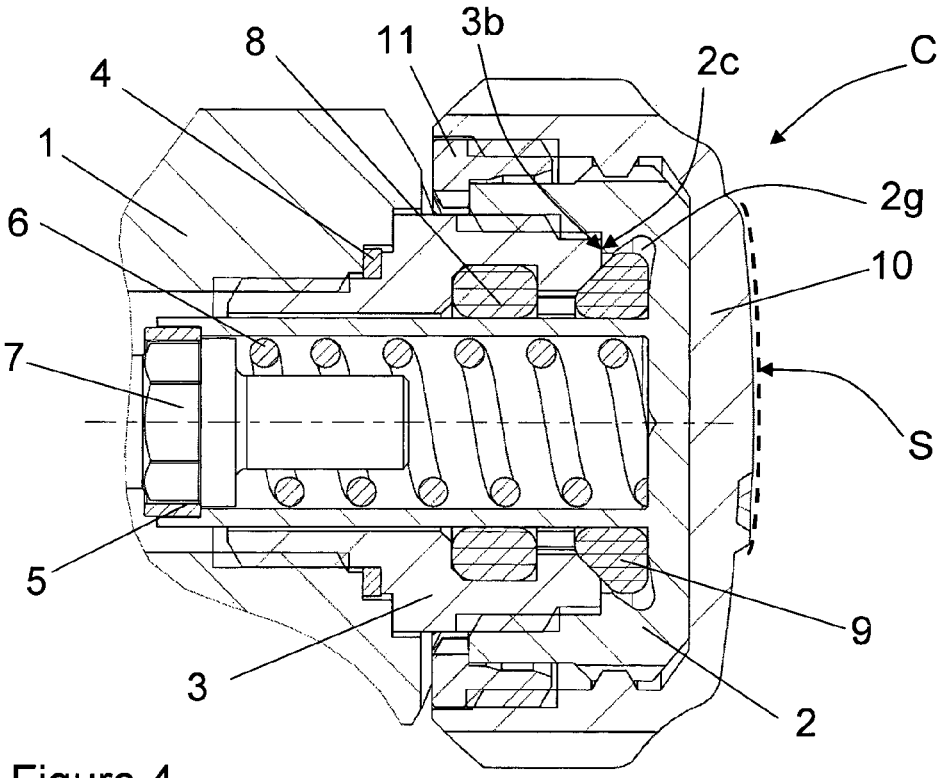
FIG. 4 is another variant of this first embodiment.

In another variant of the first embodiment represented in FIG. 4, the crown C is designed such that its diameter is reduced.

For this purpose, an annular hollow 2*g* is provided in the base of the inner part 2. This annular hollow 2*g* is designed to permit the expansion of the O-ring seal 9 when it is compressed. The geometry of this hollow 2*g* makes it possible to guarantee steady support between the surface 3*b* of the tube 3 and the surface 2*c* of the inner part 2, whilst reducing the dimension of the crown C.

The fitting and orientation of the first embodiment of the crown C on the middle 1 of the watch case are carried out according to the following steps.

In a first step, the tube 3 is screwed in a sealed manner into the middle 1, with interposition of the seal 4. The sub-assembly A, constituted by the inner part 2 of the crown C, connected to the elements 5, 6 and 7, as well as the rod 12 of the winding mechanism, is screwed onto the tube 3. This screwing is carried out until the sub-assembly A is screwed to a torque which is close to the maximum torque which the user of the watch can exert on the crown. The surfaces respectively 3*b* of the tube 3, and 2*c* of the inner part 2 of the crown C, which are both perpendicular to the longitudinal axis of the tube 3, are then in rigid mechanical contact, thus constituting axial stops which define a reproducible screwing position.

In a second step, the outer part 10 of the crown C is introduced by axial translation on the sub-assembly A which is already screwed onto the middle 1, whilst imparting to the symbol S the angular orientation which is closest to that required. During this translation, the indexing toothing or grooves 2*a* of the inner part and 10*a* of the outer part interpenetrate one another. The precision of the angular orientation of the symbol S of the outer part 10 around the longitudinal axis of the tube 3 depends on the pitch of the toothing or grooves 2*a*, 10*a*. The smaller this pitch is, the better the precision of the angular positioning of the symbol S.

In a third step, the sub-assembly A on which the outer part 10 is arranged is unscrewed whilst maintaining the contact between the surfaces 2*b* and 10*b*, until the thread 2*d* has separated from the thread 3*a* of the tube 3.

In a fourth step, the sub-assembly A and the outer part 10 of the crown C are displaced together in translation such as to obtain complete withdrawal of these two elements relative to the middle 1. For this purpose, the length of the toothing 2*a* of the inner part 2 must be sufficient for the indexing means 2*a* of the sub-assembly A and those 10*a* of the outer part 10 to remain engaged, since the two parts 2 and 10 of the crown C have not yet been rendered integral with one another.

In a fifth step, the thread 11*a* of the blocking ring 11 is screwed into the thread 10*c* of the outer part 10 by means of a tool which is engaged respectively with the grooves 11*c* and 10*d*. The screwing of the parts 10 and 11 makes it possible to keep the toothing or grooves 2*a* and 10*a* engaged when the support surface 11*b* is pressed against the end 2*e* of the lateral wall 2*h* of the inner part 2, and to make up for the initial play, thus permitting the introduction of the inner part 2 into the outer part 10.

The preceding operations have made it possible to render the sub-assembly A integral with the outer part 10 of the crown C, and to obtain a complete crown C.

The crown C and in particular its inner part 2 is then screwed again onto the tube 3, and the distinctive mark S is placed once more in the angular position selected during the second step. This operation can be repeated without loss of orientation of the distinctive mark S in view of the rigid contact between the stop surfaces 3*b* and 2*c* perpendicular to the longitudinal axis of the tube 3, thus guaranteeing the reproducibility of the angular position of the screwed-on crown C, and therefore that of the mark S.

Figure 5:
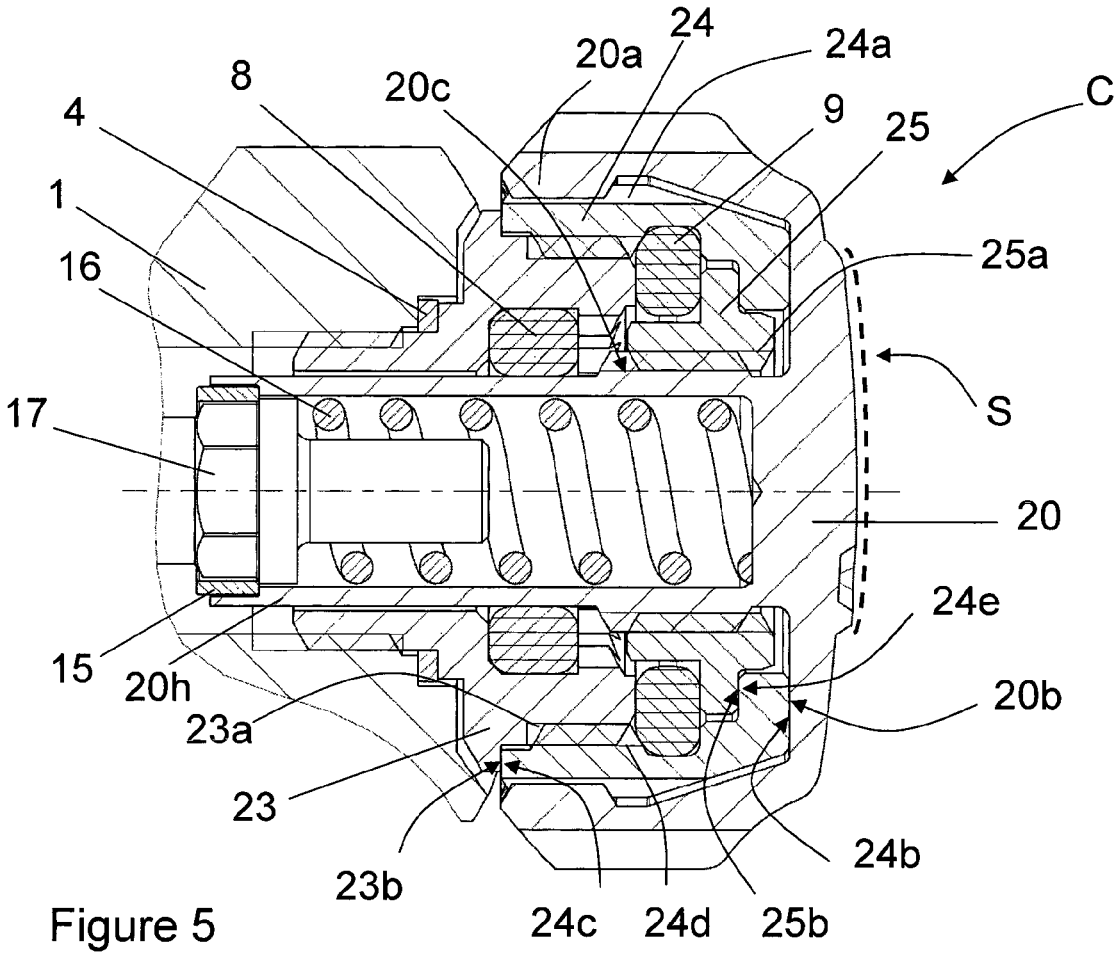
FIG. 5 is a partial view in cross-section of a watch case on a radial plane which passes via the axis of the rod of the winding mechanism, according to the second embodiment of the invention.
Figure 6:
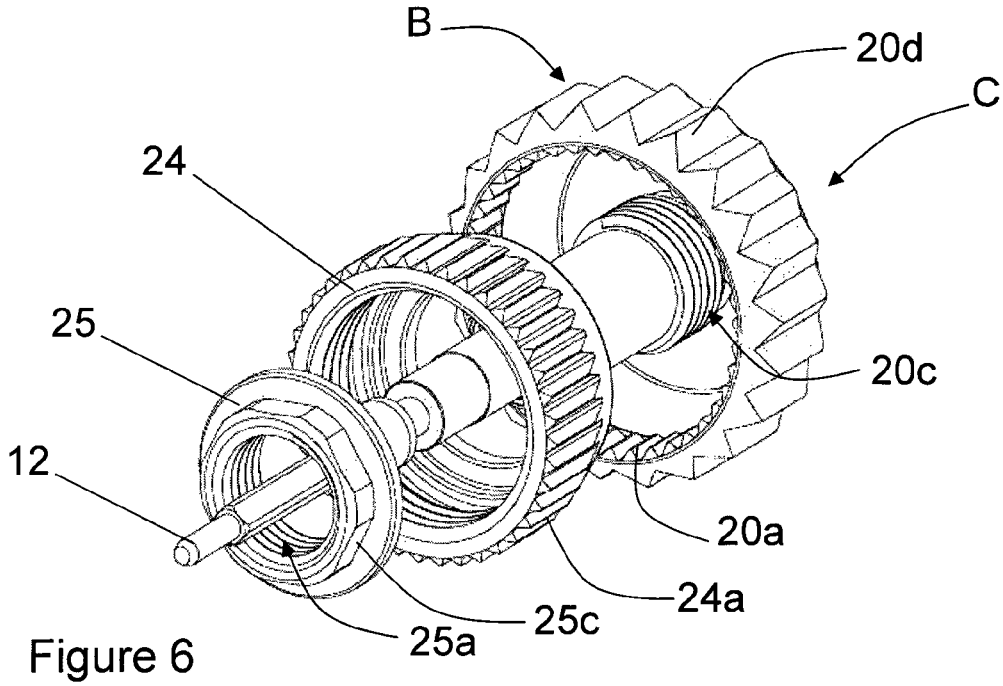
FIG. 6 is an exploded perspective view of the winding mechanism crown of the second embodiment.

In the second embodiment represented in FIGS. 5 and 6, the outer part 20 which bears the symbol S has a tube 20*h*, to the end of which a coupling ring 15 with a polygonal opening is secured. A helical spring 16 presses a coupling element with a polygonal profile 17, which is integral with the rod 12 of the winding mechanism. This polygonal profile is complementary to that of the polygonal opening of the ring 15 in which it is engaged. These parts form a sub-assembly B once they are associated with the rod 12 of the winding mechanism.

In order to enable this sub-assembly B which bears the symbol S to be oriented, a thread 24*d* of the inner part is screwed onto a thread 23*a* of the tube 23. The outer part 20 and the inner part 24 are then secured to one another axially, as in the preceding embodiment, by means of a clamping ring 25.

The inner part 24 is in the form of a cylindrical ring, the outer lateral surface of which is provided with micro-toothing or grooves 24*a* engaged with complementary micro-toothing or grooves 20*a* provided on the inner lateral surface of the outer part 20 of the crown C. The inner surface of the ring 24 comprises an axial stop surface 24*c* in order to come into contact with a support surface 23*b* of the tube 23. These stop surfaces 23*b*, 24*c* are perpendicular to the longitudinal axis of the tube 23, and act as stops in order to determine a limit screwing position of the crown C which is reproducible, thus making it possible to guarantee the precision of the angular position of the distinctive mark S.

The clamping ring 25 is used to render the sub-assembly B and the ring 24 integral by means of a thread 25*a* which is provided in its axial opening, and is engaged with a thread 20*c* provided on the outer lateral surface of the tubular sleeve 20*h* of the outer part 20 of the crown C, such as to keep the stop surfaces 20*b* and 24*b* supported, as well as the support surface 25*b* of the ring with the axial stop surface 24*e* of the inner part 24.

In this second embodiment, the fitting and orientation of the screwed crown C are carried out according to the following steps.

In a first step, the ring 24 is screwed onto the tube which is already rendered integral in a sealed manner with the middle 1 by means of a seal 4. This screwing is stopped once the ring 24 is screwed to a torque which is close to the maximum torque which the user of the watch will exert on its crown C, and the support surface 23*b* is in rigid mechanical contact with the end 24*c* of the inner part 24 of the crown C.

In a second step, the sub-assembly B constituted by the outer part 20 connected to the coupling elements 15, 16, 17 and to the rod 12 of the winding mechanism is introduced axially and is oriented angularly on the ring 24, whilst engaging the toothing or grooves 24*a* and 20*a*. The angular orientation of the sub-assembly B is that which is to be imparted to the symbol S.

In a third step, the sub-assembly B and the ring 24 are unscrewed, whilst maintaining the contact between the stop surfaces 20*b* and 24*b*, until the threads 23*a* and 24*d* are separated.

In a fourth step, the sub-assembly B and the ring 24 are displaced together such as to obtain complete withdrawal of these two elements relative to the rest of the case. For this purpose, the length of the toothing or grooves 24*a* of the ring 24 must be sufficient for the outer part 20 and the inner part 24 of the crown C to remain engaged and retain their respective orientation relative to one another, since they have not yet been rendered integral.

In a fifth step, the clamping ring 25 is introduced according to the longitudinal axis of the rod 12 of the winding mechanism. Then, the ring 25 is screwed onto the thread 20*c* of the tubular sleeve 20*h*, and is clamped by means of a tool which is engaged firstly with the grooves 20*d* and with grasping means, in this case a polygonal profile 25*c* (FIG. 6) which is provided on an outer lateral surface of the clamping ring 25.

The preceding operations have made it possible to render the sub-assembly B integral with the inner part 24 of the crown, and to obtain a complete crown C with the distinctive mark S.

The seal 9 is then positioned between the inner part 24 and the clamping ring 25. Once the crown C has been screwed back onto the tube 23, the distinctive mark S regains the angular position selected during the second step, even after several successive screwing and unscrewing operations, by means of the rigid contact between the support surface 23*b* and the end 24*c* of the inner part 24.

The invention claimed is:

1. A watch case comprising:

a middle, a tube which is provided with a thread and is integral with the middle, a control crown provided with a thread which can be screwed onto the thread of said tube, the control crown comprising an outer part with a distinctive mark which can be seen from the exterior, and an inner part which is accommodated inside the outer part and is provided with said thread which can be screwed onto the thread of the tube, one of said parts comprising means for connection to a control rod, and in particular to a rod of a winding mechanism, and clamping means in order to keep said outer part and said inner part in an angular position which is determined relative to the longitudinal axis of said tube, characterized in that wherein said inner part comprises first angular indexing means, the outer part comprises second angular indexing means, these indexing means being formed such as to engage axially in one another by means of relative axial displacement between the inner part and the outer part, these indexing means being kept engaged by said clamping means.

2. The watch case as claimed in claim 1, wherein said indexing means comprise two circular surfaces which are coaxial to the longitudinal axis of said tube, and are provided with toothing or grooves which are complementary and integral respectively with said outer part and said inner part.

3. The watch case as claimed in claim 2, wherein said clamping means comprise a ring which has firstly a thread which is engaged with a corresponding thread provided on one of said parts of the crown, and secondly an axial support surface which is supported against an axial stop of the other one of said parts of the crown.

4. The watch case as claimed in claim 3, wherein said outer and inner parts each have a base and a lateral wall, the inner surface of the lateral wall of the inner part having the thread engaged with the thread of the tube, the inner surface of the lateral wall of the outer part having said indexing means as well as a thread which is situated between the open end of said lateral wall and said indexing means, this thread being engaged with an outer thread of said clamping ring, the inner edge of which has an axial support surface which is supported axially against an axial stop surface of the lateral wall of the inner part, the base of said inner part being integral with a tubular sleeve comprising said means for connection to a control rod.

5. The watch case as claimed in claim 4, wherein the inner part has an annular receptacle in which an annular seal is placed, this annular receptacle being delimited on the interior by the outer surface of said tube which ends in a frusto-conical surface.

6. The watch case as claimed in claim 3, wherein the screwed position of the crown on said tube is defined by the rigid contact of two surfaces which are perpendicular to the longitudinal axis of said tube.

7. The watch case as claimed in claim 2, wherein the screwed position of the crown on said tube is defined by the rigid contact of two surfaces which are perpendicular to the longitudinal axis of said tube.

8. The watch case as claimed in claim 7, wherein said outer and inner parts each have a base and a lateral wall, the inner surface of the lateral wall of the inner part having the thread engaged with the thread of the tube, the inner surface of the lateral wall of the outer part having said indexing means as well as a thread which is situated between the open end of said lateral wall and said indexing means, this thread being engaged with an outer thread of said clamping ring, the inner edge of which has an axial support surface which is supported axially against an axial stop surface of the lateral wall of the inner part, the base of said inner part being integral with a tubular sleeve comprising said means for connection to a control rod.

9. The watch case as claimed in claim 8, wherein the inner part has an annular receptacle in which an annular seal is placed, this annular receptacle being delimited on the interior by the outer surface of said tube which ends in a frusto-conical surface.

10. The watch case as claimed in claim 1, wherein said clamping means comprise a ring which has firstly a thread which is engaged with a corresponding thread provided on one of said parts of the crown, and secondly an axial support surface which is supported against an axial stop of the other one of said parts of the crown.

11. The watch case as claimed in claim 10, wherein said outer and inner parts each have a base and a lateral wall, the inner surface of the lateral wall of the inner part having the thread engaged with the thread of the tube, the inner surface of the lateral wall of the outer part having said indexing means as well as a thread which is situated between the open end of said lateral wall and said indexing means, this thread being engaged with an outer thread of said clamping ring, the inner edge of which has an axial support surface which is supported axially against an axial stop surface of the lateral wall of the inner part, the base of said inner part being integral with a tubular sleeve comprising said means for connection to a control rod.

12. The watch case as claimed in claim 11, wherein the inner part has an annular receptacle in which an annular seal is placed, this annular receptacle being delimited on the interior by the outer surface of said tube which ends in a frusto-conical surface.

13. The watch case as claimed in claim 10, wherein said clamping means comprise means in order to allow a clamping tool to be engaged with the clamping means.

14. The watch case as claimed in claim 10, wherein the screwed position of the crown on said tube is defined by the rigid contact of two surfaces which are perpendicular to the longitudinal axis of said tube.

15. The watch case as claimed in claim 14, wherein said outer and inner parts each have a base and a lateral wall, the inner surface of the lateral wall of the inner part having the thread engaged with the thread of the tube, the inner surface of the lateral wall of the outer part having said indexing means as well as a thread which is situated between the open end of said lateral wall and said indexing means, this thread being engaged with an outer thread of said clamping ring, the inner edge of which has an axial support surface which is supported axially against an axial stop surface of the lateral wall of the inner part, the base of said inner part being integral with a tubular sleeve comprising said means for connection to a control rod.

16. The watch case as claimed in claim 15, wherein the inner part has an annular receptacle in which an annular seal is placed, this annular receptacle being delimited on the interior by the outer surface of said tube which ends in a frusto-conical surface.

17. The watch case as claimed in claim 1, wherein the screwed position of the crown on said tube is defined by the rigid contact of two surfaces which are perpendicular to the longitudinal axis of said tube.

18. The watch case as claimed in claim 17, wherein said outer and inner parts each have a base and a lateral wall, the inner surface of the lateral wall of the inner part having the thread engaged with the thread of the tube, the inner surface of the lateral wall of the outer part having said indexing means as well as a thread which is situated between the open end of said lateral wall and said indexing means, this thread being engaged with an outer thread of said clamping ring, the inner edge of which has an axial support surface which is supported axially against an axial stop surface of the lateral wall of the inner part, the base of said inner part being integral with a tubular sleeve comprising said means for connection to a control rod.

19. The watch case as claimed in claim 18, wherein the inner part has an annular receptacle in which an annular seal is placed, this annular receptacle being delimited on the interior by the outer surface of said tube which ends in a frusto-conical surface.

20. The watch case as claimed in claim 1, wherein the base of said outer part comprises a base which is integral with a tubular sleeve comprising said means for connection to a control rod , the outer surface of this tubular sleeve having a thread onto which said clamping unit is screwed, said inner part having the form of a cylindrical ring, the inner surface of which has an axial stop surface which is in contact with a support surface of said clamping unit, the inner surface of this cylindrical ring comprising a thread is screwed onto the thread of said tube the outer surface of this cylindrical ring comprising said indexing means engaged with the indexing means provided on the inner surface of the lateral wall which is integral with the periphery of the base of said outer part.

* * * * *